US009929462B2

(12) United States Patent
Long

(10) Patent No.: US 9,929,462 B2
(45) Date of Patent: Mar. 27, 2018

(54) MULTIPLE LAYER DIELECTRIC PANEL DIRECTIONAL ANTENNA

(76) Inventor: Xizhong Long, Shaoyang (CN)

( * ) Notice: Subject to any disclaimer, the term of this patent is extended or adjusted under 35 U.S.C. 154(b) by 881 days.

(21) Appl. No.: 13/494,001

(22) Filed: Jun. 11, 2012

(65) Prior Publication Data

US 2012/0313822 A1 Dec. 13, 2012

Related U.S. Application Data

(60) Provisional application No. 61/495,519, filed on Jun. 10, 2011.

(51) Int. Cl.
*H01Q 1/38* (2006.01)
*H01Q 9/04* (2006.01)

(52) U.S. Cl.
CPC ..... *H01Q 1/38* (2013.01); *H01Q 9/0407* (2013.01)

(58) Field of Classification Search
CPC ..... H01Q 1/38; H01Q 1/40; H01Q 1/422; H01Q 9/0407; H01Q 9/0428
USPC ..... 343/700 MS, 873
See application file for complete search history.

(56) References Cited

U.S. PATENT DOCUMENTS 3,713,166 A * 1/1973 Munson ..... H01Q 1/286 333/26
4,458,249 A 7/1984 Valentino et al.
4,480,254 A 10/1984 Spencer et al.
4,827,271 A 5/1989 Berneking et al.
5,155,493 A 10/1992 Thursby et al.
5,315,753 A 5/1994 Jensen et al.
5,438,697 A 8/1995 Fowler et al.
5,898,403 A 4/1999 Saitoh et al.
5,926,136 A 7/1999 Ohtsuka et al.
6,384,785 B1 5/2002 Kamogawa et al.
6,567,048 B2 5/2003 McKinzie, III et al.
6,930,639 B2 * 8/2005 Bauregger et al. .... 343/700 MS
7,286,094 B2 10/2007 Ratni et al.
7,425,922 B1 * 9/2008 Adams ..... 343/700 MS
7,446,711 B2 11/2008 Jow et al.
7,642,970 B2 1/2010 Aoyama et al.
8,018,397 B2 9/2011 Jow et al.
2008/0129619 A1 * 6/2008 Lee ..... H01Q 1/1271 343/713
2009/0027294 A1 * 1/2009 Bourry ..... H01Q 21/293 343/848
2010/0164827 A1 7/2010 Miyagawa et al.

* cited by examiner

*Primary Examiner* — Peguy Jean Pierre
(74) *Attorney, Agent, or Firm* — Brian W. Foxworthy; Robert R. Waters; Waters Law Group, PLLC

(57) ABSTRACT

A directional antenna has a body made of a stack of layers of dielectric panels. A radiating plate is recessed in the top panel of the stack. A grounding plate is attached to the bottom panel of the stack. A feed wire attaches to the radiating plate to feed a signal to the radiating plate. A grounding conductor attaches to the grounding plate for ground. In at least one embodiment the internal feed wire of a coaxial connector provides the feed wire and the external chassis of the coaxial connector provides the grounding conductor.

6 Claims, 6 Drawing Sheets

MULTIPLE LAYER DIELECTRIC PANEL DIRECTIONAL ANTENNA

This application claims priority from U.S. Provisional Application No. 61/495,519, filed on Jun. 10, 2011. The entire disclosure contained in U.S. Provisional Application 61/495,519, including the attachments thereto, is incorporated herein by reference.

FIELD OF THE INVENTION

This application relates to the field of transmitter and receiver antennas in the ultra-high frequency (UHF) band. More specifically, this application relates to antennas for directional transmission over long distances.

BACKGROUND OF THE INVENTION

Wireless communication systems are ubiquitous and have demanding requirements for their signal transmission components. Components that transmit and receive the signal must be small and easily packaged within the wireless system as well as economically manufactured. A key transmission component is the transmission antenna. Although the antenna must be small, it must also provide high gain and have the capability to produce a directional transmission. The effectiveness of the directional aspect of the antenna may be measured by the ratio of signal strength in the desired direction to signal strength in the opposite direction. This ratio may be called the front-to-back ratio. Current antennas in wireless systems are inconveniently large, and expensive to manufacture. Therefore, there is a need for improvement in transmission antennas, including in their size, effectiveness, and cost, particularly for those used in wireless communication systems.

SUMMARY OF THE INVENTION

To overcome the several weaknesses of current directional antennas, such as excessive size, high cost, difficult application integration, and lack of portability, the many possible embodiments of the directional antenna of the present invention utilize a radiating element and multiple layers of dielectric panel. The multiple layer dielectric panel portion of the directional antenna design comprises a novel, stacked structure that can use conventional printed circuit board (PCB) material as the dielectric panel material to accomplish reduced size and lower cost. By passing the signal through a stack of PCB type layers with different dielectric coefficients and different thicknesses, the signal field can be shaped and directed. While realizing substantial cost savings from a low cost manufacturing process, this antenna provides excellent directional performance. One embodiment of the directional antenna of the present invention provides a high gain of approximately 6 dBi and a high front-to-back ratio of up to 18-20 dB.

The invention in the present application capitalizes on the phenomenon that an electromagnetic wave travels through dielectric material much slower than it travels through air. Embodiments of the directional antenna stack multiple layers of dielectric material with same or different dielectric constants and same or different thicknesses between the top transmission layer, which contains the radiating element, and the bottom ground layer. This achieves a much smaller antenna ground area, thus decreasing the dimensions of overall antenna. Modeling and experimentation indicate that the higher the dielectric constant of the middle layers and the thicker those middle layers, the smaller the size of the antenna. The antenna can be square, rectangular, or round in shape, and, optimally, the minimum dimension across the ground layer should be no less than ¼ of the wavelength of the operating frequency of the antenna. The transmission layer at the top can be smaller in area than the ground layer. The antenna can incorporate a standard connector such as a 50 ohm or 75 ohm coaxial connector for easy connection to a transmitter circuit. The chassis of the connector is soldered to the antenna's ground layer, and the central feed wire of the connector is soldered to the radiating element in the transmission layer. According to the specific impedance of the particular antenna design, the feedback point can be positioned at different locations on the transmission layer.

DETAILED DESCRIPTION OF EMBODIMENTS

Figure 1:
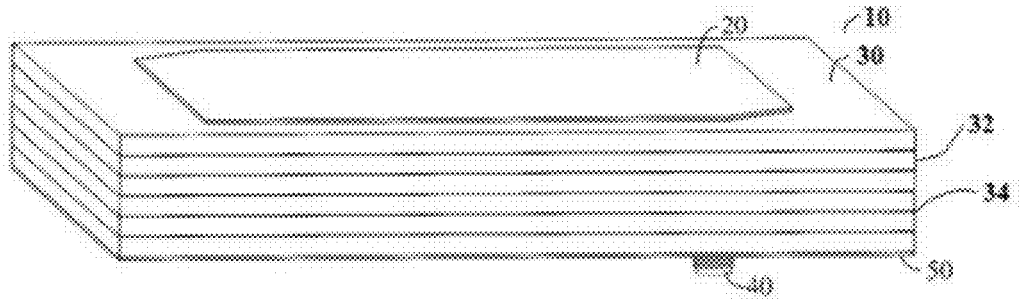
FIG. 1 is a perspective view of an embodiment of an antenna of the present invention.

FIG. 1 is a perspective view of an embodiment of an antenna 10 of the present invention. Antenna 10 has a radiating element 20 embedded within a shaping body 30. Shaping body 30 is comprised of multiple layers 32 of a dielectric material, such as printed circuit board (PCB) material. Each layer 32 is in full contact with neighboring layers to form a contiguous stack with negligible voids in shaping body 30. Connector 40 at the bottom of shaping body 30 provides a site for connecting to an external connection. Connector 40 conducts a signal to radiating element 20 within shaping body 30. Ground plate 50 at the bottom of the stack of layers 32 provides the ground structure for directional antenna 10 as well as serving to reflect upward the signal from radiating element 20.

Figure 2:
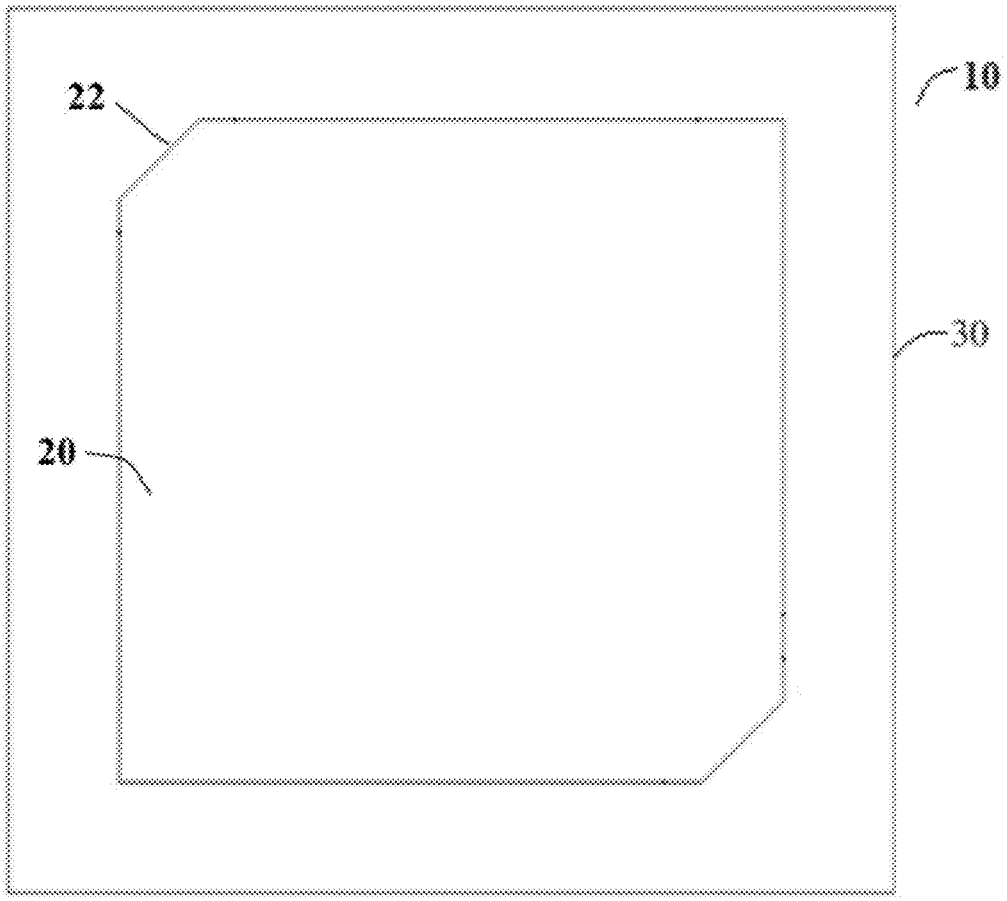
FIG. 2 is a top view of the embodiment shown in FIG. 1.

FIG. 2 is a top view of the embodiment of antenna 10 shown in FIG. 1. From the top it can be seen that radiating element 20 is generally centered within shaping body 30 about the vertical axis (z axis). Also, radiating element 20 generally has the contours of shaping body 30, with a border of material surrounding and enclosing the perimeter of radiating element 20. The corner cuts of the rectangular radiating element 20 are designed to extend directional antenna's 10 bandwidth.

Figure 3:
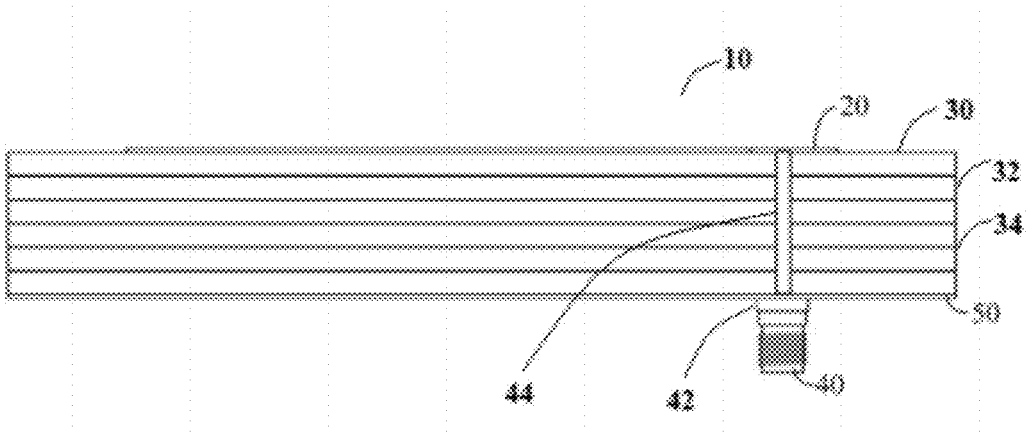
FIG. 3 is a side section view of an embodiment of a directional antenna of the present invention.

FIG. 3 is a side section view of an embodiment of directional antenna 10. In FIG. 3, it can be seen that layers 32 form a contiguous stack without spacing or voids. In the embodiment of directional antenna 10 shown in FIG. 3, radiating element 20 is on top of the top layer of layers 32 of shaping body 30 rather than embedded in it as shown in FIGS. 1 and 2. Ground plate 50 is more distinguishable in FIG. 3 at the bottom of shaping body 30. Radiating element 20 is made of a material suitable for radiating a field or signal, while ground plate 50 is made of a material suitable to ground directional antenna 10 and to reflect signals from radiating element 20. Both radiating element 20 and ground plate 50 may be made of copper, for example.

Layers 32 of shaping body 30 are made of dielectric material. Different layers 32 may be made of the same or different material and may have the same or different thickness. Examples of commercially available dielectric materials include FR-4 glass reinforced epoxy and Teflon. Boundaries 34 occur between adjacent layers 32 of shaping body 30.

Connector 40 can be a standard connector such as SMA connector used for coaxial cable to transfer the signal. Chassis 42 of connector 40 is connected to ground plate 50, for example by soldering. Central feed wire 44 of connector 40 passes through ground plate 50 and layers 32 of shaping body 30 and connects to radiating element 20. In the embodiment of directional antenna 10 shown in FIG. 3, connector 40 is off center.

Figure 4:
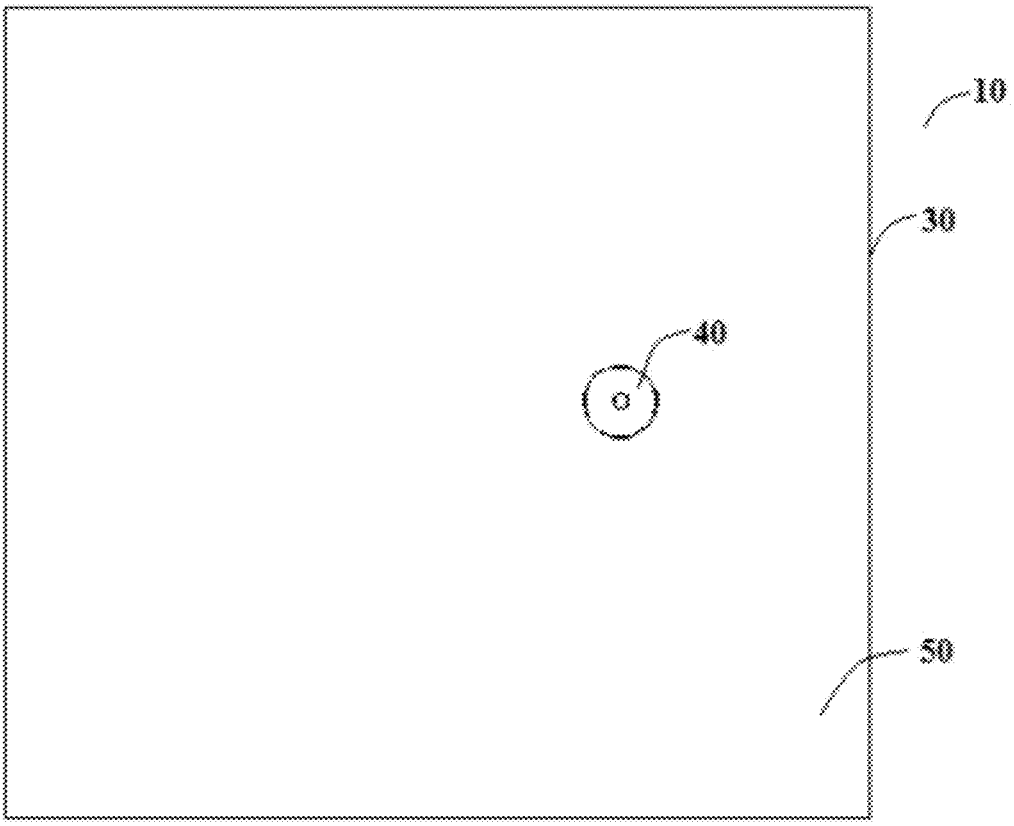
FIG. 4 is a bottom view of the embodiment shown in FIG. 1.

FIG. 4 is a bottom view of the embodiment of antenna 10 shown in FIG. 1. Connector 40 is somewhat offset in its location in the bottom surface of shaping body 30. In FIG. 4 connector 40 is a coaxial connector.

Figure 5:
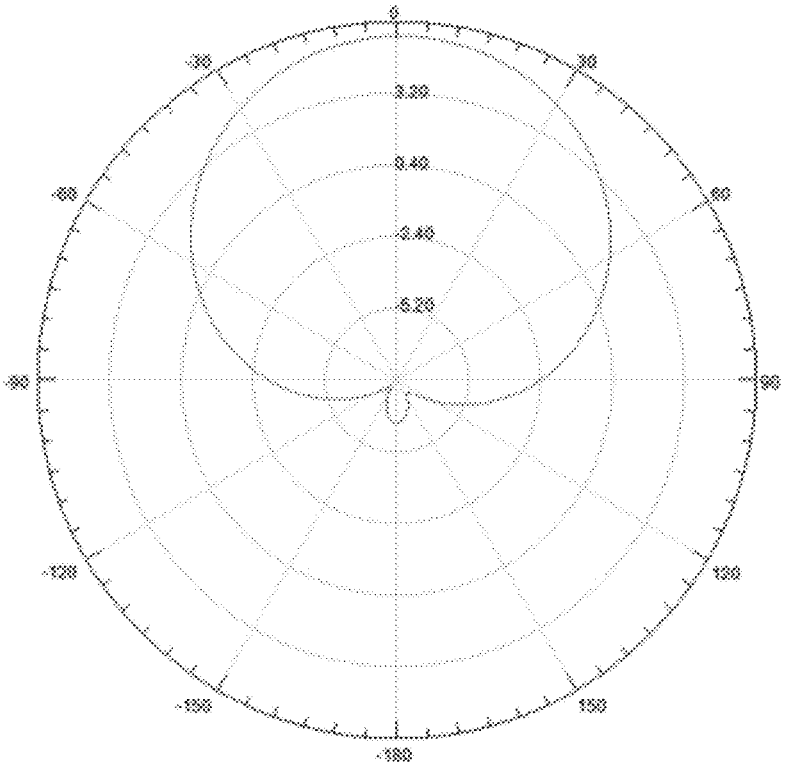
FIG. 5 is a 2 dimensional map of the field generated by the embodiment shown in FIG. 1.

FIG. 5 is a 2 dimensional map of the field generated by the embodiment shown in FIG. 1 to illustrate the directional performance of the antenna. In FIG. 5, it may be seen that the field is centered about the vertical z axis like antenna 10 and directed upward. The horizontal axis of the graph corresponds to the bottom of the ground plate, and it can be seen that only a minimal amount of field is project from the bottom of the antenna. The higher gain region of the field is in its upper regions.

The specific physical embodiment shown in FIGS. 1, 2, 3, and 4 is a 915 MHz directional antenna manufactured in layers as discussed above. It dimensions are 120 mm(L)×120 mm(W)×21 mm(H) square shape with multiple layers of PCB panel. From FIG. 3, a SMA connector 40 is soldered to antenna ground layer 50 and the connector's central feed wire is soldered to radiating element 20. The middle layers are FR4-S0401 prepreg PCB material. Corner cuts 22 of radiating element 20, best seen in FIG. 2, can expand antenna's 10 bandwidth. FIG. 5 is a graph of the simulation result of this particular antenna's effectiveness, and testing results show a 6 dBi gain and 18-20 db front-to-back ratio. Other physical dimensions and constructions may be used for other applications and situations.

Figure 6:
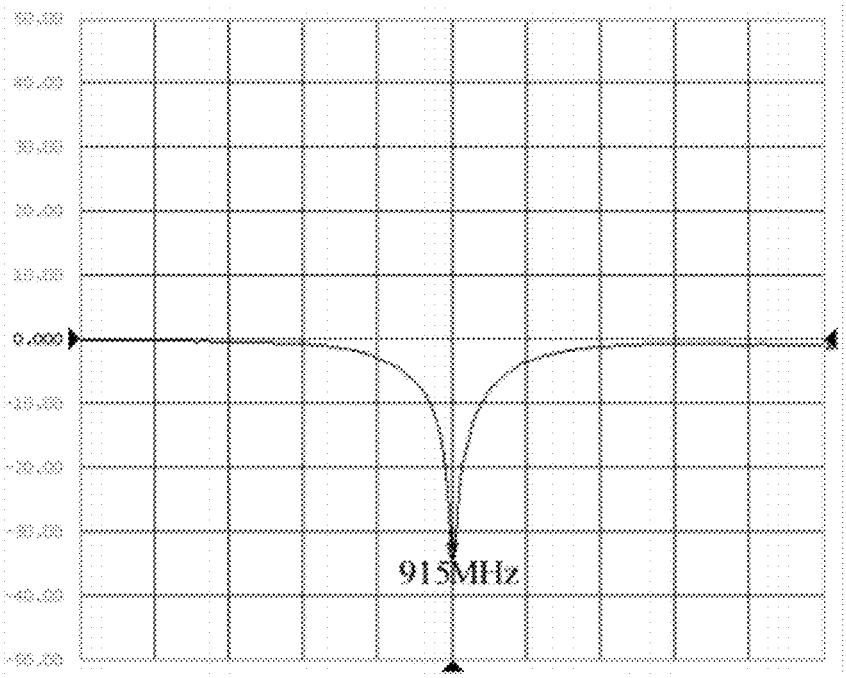
FIG. 6 is the instrument testing diagram of an embodiment of an antenna of the present invention—log plot.
Figure 7:
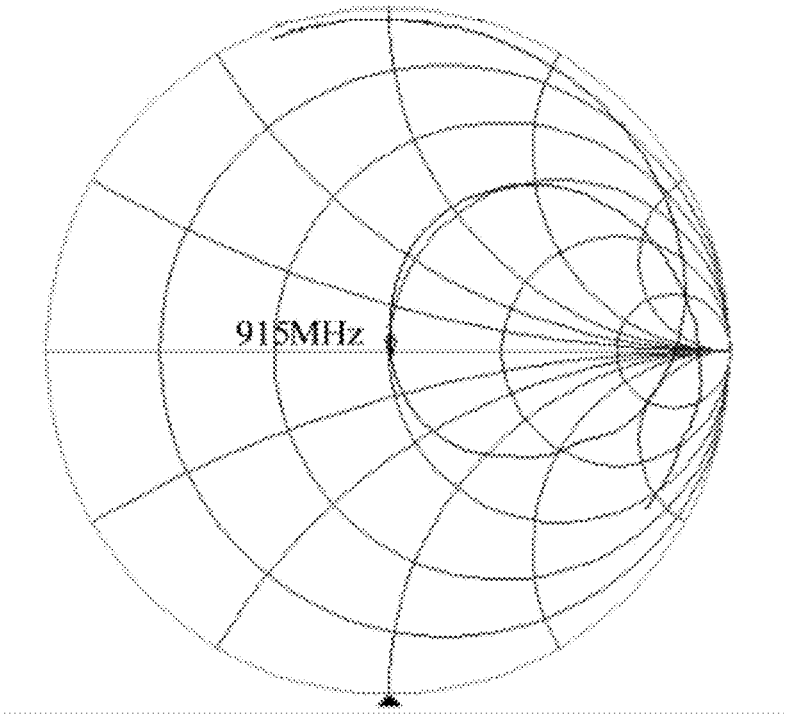
FIG. 7 is the instrument testing diagram of an embodiment of an antenna of the present invention—Smith plot.
Figure 8:
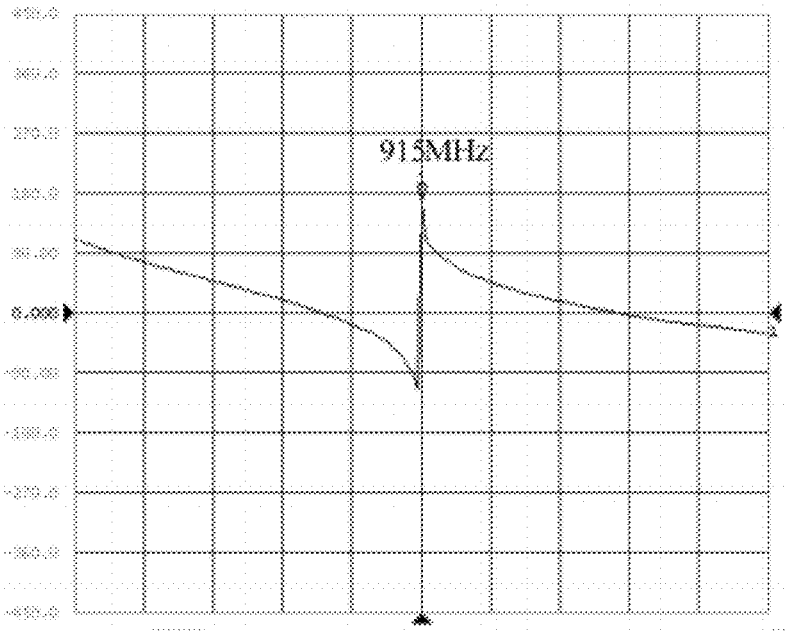
FIG. 8 is the instrument testing diagram of an embodiment of an antenna of the present invention—Phase plot.
Figure 9:
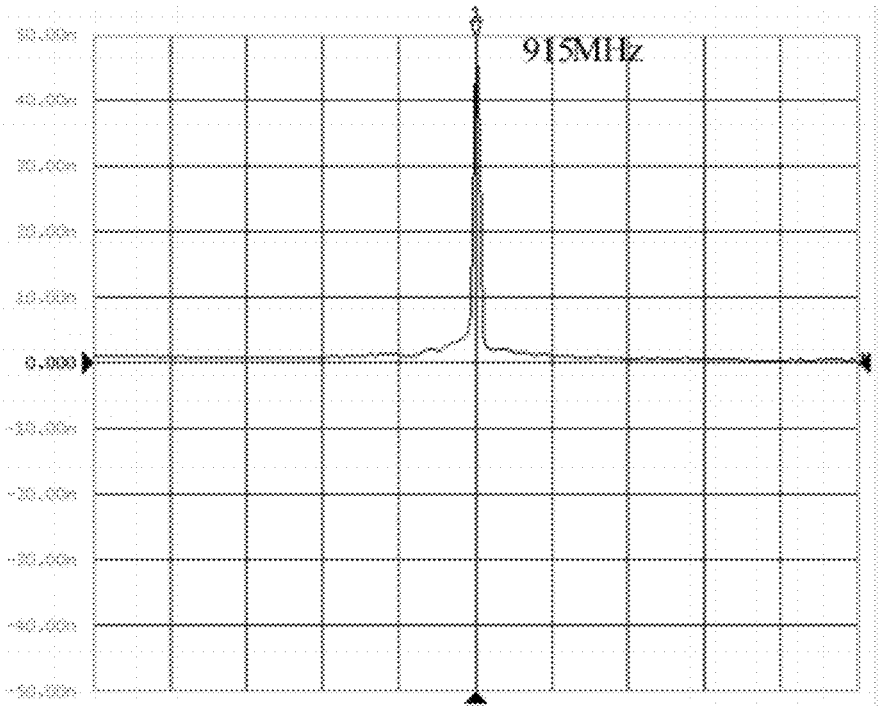
FIG. 9 is the instrument testing diagram of an embodiment of an antenna of the present invention—Delay plot.
Figure 10:
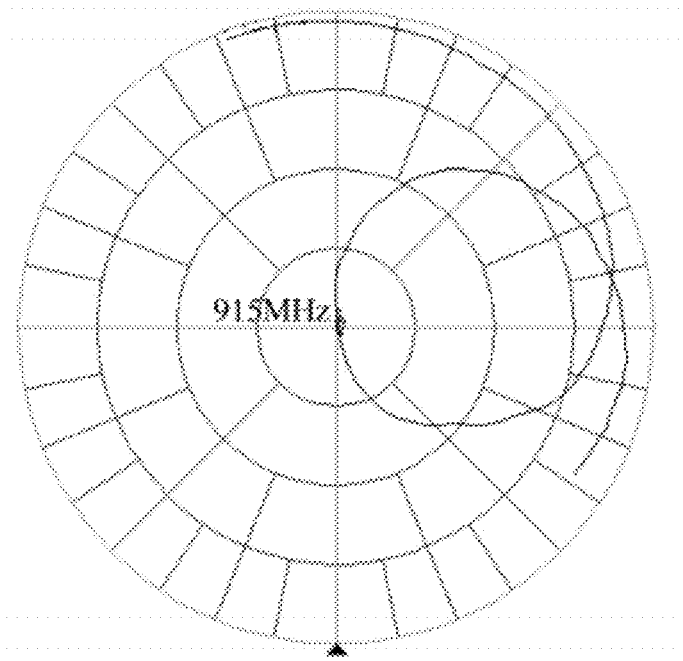
FIG. 10 is the instrument testing diagram of an embodiment of an antenna of the present invention—Polar plot.
Figure 11:
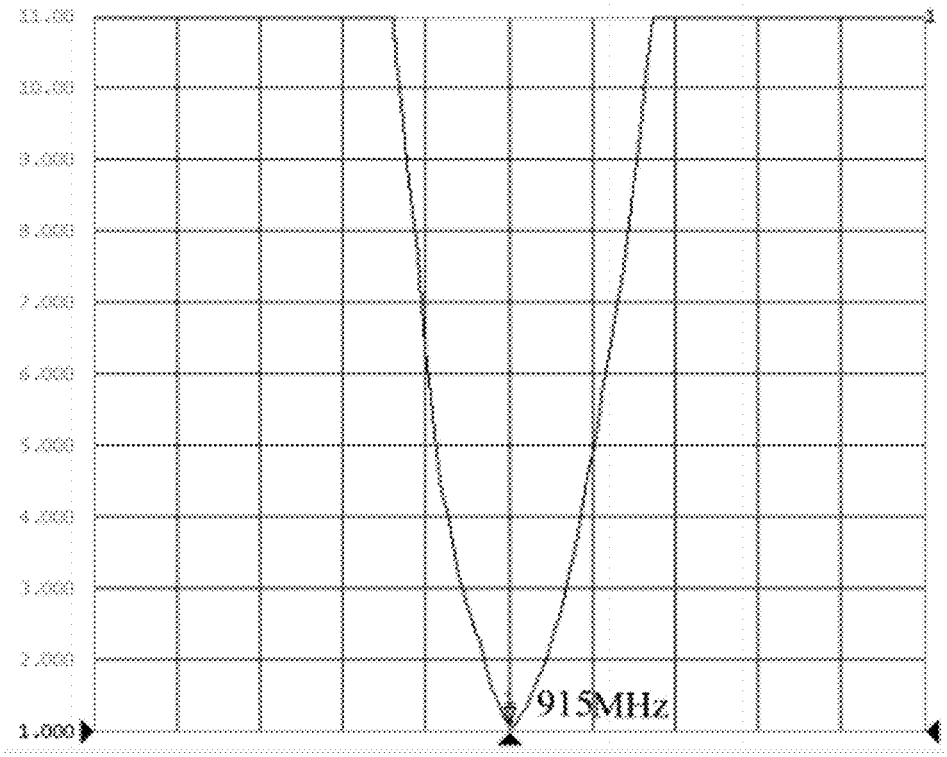
FIG. 11 is the instrument testing diagram of an embodiment of an antenna of the present invention—SWR plot.

FIGS. 6-11 are graphs of measured characteristics of the particular embodiment described above. The antenna is operated at the stated 915 MHz. FIG. 6 presents the measured log-plot of the field pattern's return loss showing the antenna radiates best at 915 MHz. FIG. 7 presents the embodiment's measured data in Smith Chart form displaying the antenna impedance. The data shows that the antenna's impedance is precisely matched at 915 MHz. FIG. 8 is a measured phase plot of the embodiment showing the phase changes little in the radiated pattern at 915 MHz. FIG. 9 shows that the antenna emits at a small frequency range centered on 915 MHz resulting in a high antenna Q. FIG. 10 displays the embodiments measured polar plot, showing the antenna is in nearly perfectly matched at 915 MHz. FIG. 11 displays the Standing Wave Ratio (SWR) by frequency of the embodiment, clearly showing an SWR of 1.0 at 915 MHz.

Figure 12:
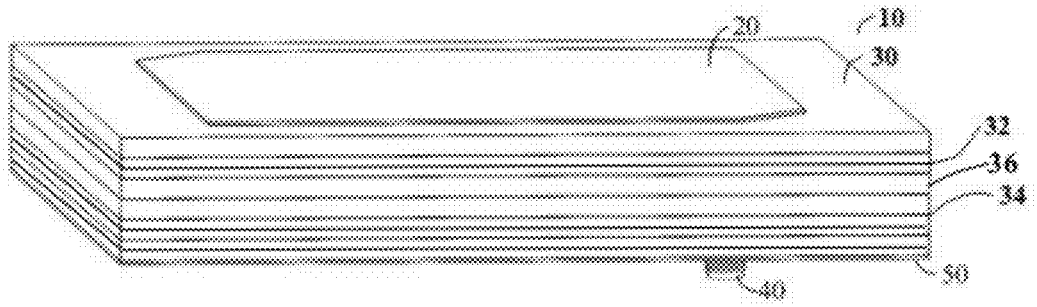
FIG. 12 is a perspective view of a second embodiment of a directional antenna.

FIG. 12 is a perspective view of a second embodiment of a directional antenna. In FIG. 12, middle layers 36 are thicker than those above and below them. Modeling and experimentation indicate that the higher the dielectric constant of the middle layers and the thicker those middle layers, the smaller the size of the antenna.

Although at least one specific embodiment of a directional antenna is described above, it should be understood that many other embodiments are possible and that the invention of the current application should not be limited to the specific examples described. Additionally, the structure of the directional antenna may be maintained with any of several possible techniques. For example, the several layers may be held together by adhesives between the layers, or held together by screws passing through the several layers, or held together by an external frame clamping the layers together, etc. Other techniques are possible as well.

I claim:

1. A directional antenna comprising:

a shaping body, a radiating element, a ground plate, a feed wire, and a ground conductor;

said shaping body comprising a stack of at least four layers of solid dielectric material, said stack having a top and a bottom, a top layer at its top, a bottom layer at its bottom, and a plurality of middle layers between said top layer and bottom layer, each said layer having a flat top surface and a flat bottom surface opposite its top surface, the top surface of each layer being in contact with the bottom surface of the layer above it, excepting the top surface of the top layer which is exposed and defines a plane, said stack being without voids between said layers;

said radiating element comprising a plate made of conductive material and having a flat top surface and a bottom surface opposite its top surface, said top and bottom surfaces of said plate having a smaller surface area than said top of said stack, said radiating element being embedded in said top of said shaping body to a depth where said top surface of said radiating element lies in said plane defined by said top surface of said top layer of said stack, said top surface of said plate being exposed;

said ground plate having a flat top surface and a bottom surface opposite its top surface, said top surface of said ground plate contacting said bottom surface of said bottom layer of said stack without voids between said ground plate and said bottom layer, said ground plate made of a conductive material;

said feed wire attaching to said radiating element; and, said ground conductor attaching to said ground plate.

2. The directional antenna of claim 1, wherein:

said radiating element is a rectangular plate.

3. The directional antenna of claim 2, wherein:

said radiating element has two opposing corners trimmed.

4. The directional antenna of claim 1, wherein:

said feed wire is the internal feed wire of a coaxial connector and said ground conductor is the external chassis of the same coaxial connector;

said ground plate further comprises an aperture;

each said layer of dielectric material has an aperture in alignment with said aperture in said ground plate;

said external chassis of said coaxial connector is attached to the bottom surface of said ground plate concentric with said aperture; and said internal feed wire of said coaxial connector passes through said apertures of said ground plate and layers of dielectric material and attaches to said bottom surface of said radiating element.

5. The directional antenna of claim 1, wherein:

said middle layers of dielectric material of said shaping body have a higher dielectric constant than said top layer and said bottom layer.

6. The directional antenna of claim 1, wherein:

said middle layers of dielectric material of said shaping body are thicker than said top layer and bottom layer.

* * * * *